US005390579A

United States Patent [19]

Burgon

[11] Patent Number: 5,390,579

[45] Date of Patent: Feb. 21, 1995

[54] TUNING OF MUSICAL INSTRUMENTS

[75] Inventor: Harold S. Burgon, London, England

[73] Assignee: Torque Talk Limited, Ashford, England

[21] Appl. No.: 958,118

[22] PCT Filed: Jun. 25, 1991

[86] PCT No.: PCT/GB91/01021

§ 371 Date: Dec. 23, 1992

§ 102(e) Date: Dec. 23, 1992

[87] PCT Pub. No.: WO92/00583

PCT Pub. Date: Jan. 9, 1992

[30] Foreign Application Priority Data

Jun. 25, 1990 [GB] United Kingdom ..... 9014140

[51] Int. Cl.[6] ..... G10G 7/02

[52] U.S. Cl. ..... 84/454; 84/DIG. 18; 84/313; 84/297 R

[58] Field of Search ..... 84/454, 455, 297 R, 84/313, DIG. 18

[56] References Cited

U.S. PATENT DOCUMENTS

| | | | |
|---|---|---|---|
| 69,259 | 9/1867 | Seehausen | 84/287 R |
| 4,281,577 | 8/1981 | Middleton | 84/454 |
| 4,608,905 | 9/1986 | Takabayashi | 84/313 |
| 4,803,908 | 2/1989 | Skinn et al. | 84/454 |
| 4,889,029 | 12/1989 | St. Denis | 84/454 |
| 4,909,126 | 3/1990 | Skinn et al. | 84/454 |
| 5,038,657 | 8/1991 | Busley | 84/455 |

FOREIGN PATENT DOCUMENTS

| | | |
|---|---|---|
| 566441 | 7/1960 | Belgium . |
| 2587528 | 3/1987 | France . |
| 2202075 | 9/1988 | United Kingdom . |

*Primary Examiner*—Howard B. Blankenship
*Assistant Examiner*—Cassandra Spyrou
*Attorney, Agent, or Firm*—Nixon & Vanderhye

[57] ABSTRACT

Apparatus (1) for varying the pitch of the strings (12) of a guitar (15) comprises a respective adjusting mechanism (10) for each string. This mechanism includes an externally threaded tubular member (20) within which one end of the string (12) is secured. Tension is applied to the string by a coil spring (124) which has one end fixed to the tubular member (20). A drive motor (34) is arranged to rotate a gear (26) whereby longitudinal movement of the tubular member (20) is effected to vary the tension in the string (12). The rotation of the drive motor (34) is effected by an electronic circuit arranged to tune the pitch of the string a reference.

19 Claims, 4 Drawing Sheets

TUNING OF MUSICAL INSTRUMENTS

The present invention relates to apparatus for varying the pitch of a stretched string and to a musical instrument incorporating such apparatus.

It is known to provide tuning apparatus comprising a sensor for sensing the pitch of a vibrating stretched string, and an indicator for indicating whether the sensed pitch corresponds to a predetermined reference pitch. Where there is no correspondence, the tension of the string is adjusted manually until the indicator shows such a correspondence.

One object of the present invention is to provide apparatus for varying the pitch of a stretched string automatically.

According to a first aspect of the present invention, there is provided apparatus for automatically varying the pitch of stretched string, said apparatus comprising detecting means arranged to produce a signal representative of the pitch produced by vibration of the stretched string, comparing means arranged to compare said representative signal with a predetermined reference and to produce an output dependent upon said comparison, and adjusting means arranged in response to said output to adjust said stretched string such that its pitch is varied.

The adjusting means may be arranged to vary the tension and/or the length of the stretched airing such that its pitch is varied.

Apparatus of the invention enables the pitch of the string to be precisely adjusted, or tuned, to the predetermined reference.

In an embodiment, said adjusting means comprises resilient means coupled to one end of the string to tension the string, said resilient means being maintained under strain opposing the tension of said stretched string, and means for adjusting the tension of said stretched string.

For example, said tension adjusting means may comprise drive means coupled to one end of the stretched string, and being actuable to adjust the tension applied in response to said output.

Said adjusting means may also comprise drive means arranged to apply a strain to one end of the string, and being actuable to adjust the strain applied in response to said output.

In an embodiment, said adjusting means comprises a member attachable to said end of the string and coupled to said drive means, for example, by way of gear means. Advantageously, the member carries a screw-thread arranged to co-operate with said gear means.

In an embodiment, said gear means comprises a gear, arranged to be rotated by said drive means, and co-operating with the screw-thread of said member whereby rotation of said gear causes movement of said member longitudinally of a string at%ached thereto. Said member attachable to the string may comprise a tubular member within which the string extends. The screw-thread may be provided externally of said tubular member and arranged for engagement with said gear means. Alternatively, the drive means may be directly coupled to said tubular member.

Preferably, said adjusting means has a null position in which said member is located intermediate extreme positions to which the member is movable longitudinally. This is advantageous when attaching a new string to the apparatus as it enables the member to be moved away from the null position in either direction. Preferably, null position switch means are provided and are arranged to signal when said adjusting means is in its null position.

The invention also extends to adjusting means for varying the strain of an elongate member, said adjusting means comprising resilient means coupled to one end of said member and arranged to apply strain thereto, said resilient means also being maintained under strain which opposes the strain of said elongate member, and further comprising separate means for adjusting the strain of said elongate member.

According to a further aspect of the invention, there is provided apparatus for varying the pitch of a stretched string comprising means maintaining a strain on said string, and separate means for adjusting the tension of said string to vary its pitch, wherein said adjusting means is arranged to vary the tension in said string in opposition to said maintaining means.

In an embodiment, the apparatus comprises storage means for storing said predetermined reference. Preferably, the storage means is arranged to store a plurality of reference values, and selector means are provided for selecting one of the stored values for use as the reference by said comparing means.

Interface means may be provided and arranged to enable the input and/or variation of the values stored in the storage means.

Indicator means arranged to be responsive to the output of said comparing means may be provided. Advantageously, the indicator means comprises visual display means. Said display means may be arranged to indicate whether the pitch of the stretched string is below, above or substantially equal to said reference. In an embodiment, the indicator means is arranged to indicate the output of the comparing means during adjustment of the string.

The detecting means arranged to produce a signal representative of pitch may be a vibration sensor arranged proximate to, or in contact with, said string. In an embodiment said detecting means comprises piezoelectric means.

In a preferred embodiment, the apparatus is arranged for automatically varying the pitch of a plurality of strings. Control means may be provided for actuating the apparatus to vary the pitch of one or more strings, the control means comprising selector means for selecting the string or strings whose pitch is to be varied. The selector means comprises individual string selection means arranged to select individual ones of the plurality of strings. Additionally and/or alternatively, the selector means comprises master selection means arranged to enable selection of all of the strings.

In a preferred embodiment, said control means comprises processor means arranged to actuate said adjusting means, said processor means being arranged to receive select signals from said selector means and to determine the reference applied to said comparator means in accordance with said select signals. Said processor means is also arranged to be responsive to signals provided by said null position switch means.

The apparatus preferably comprises a carriage to which each string of the plurality of strings is arranged to be attached, the carriage being movable longitudinally of the strings whereby movement of the carriage is arranged to vary the pitch of all of said strings. A tremolo arm may be coupled to said carriage and arranged to move said carriage.

The present invention also extends to a musical instrument comprising at leas% one stretched string, and apparatus as defined above for varying the pitch of the string.

Where more than one string is provided, %he apparatus may be arranged to vary the pitches of one or more strings individually, and/or of one or more of the strings collectively. For example, means to move the apparatus may be provided so as to vary the pitch of all the strings together.

In one embodiment, said apparatus is separate from said instrument, but is coupled thereto. Alternatively, the apparatus may be mounted on support means carried by instrument. The support means may comprise a carriage movable relative to the instrument in a direction substantially longitudinally of a said string.

There may be provided force applying means for applying a force to said carriage which acts substantially against the tension of the string or strings. Said force applying means may comprise one or more springs. The carriage may comprise one or more pinions arranged for movement relative to the instrument, for example along one or more racks. Preferably, means are provided for moving said carriage relative to the instrument thereby to vary the pitch of the strings. Said means for moving may comprise a tremolo arm coupled to said carriage.

In a preferred embodiment, said musical instrument is a guitar. The detecting means of said apparatus may comprise a plurality of sensors mounted on the bridge of the guitar with which the strings are arranged to come into contact. Preferably an individual sensor is provided for each string of the plurality of strings.

Embodiments of the present invention are hereinafter described, by way of example, with reference to accompanying drawings, in which.

Figure 1:
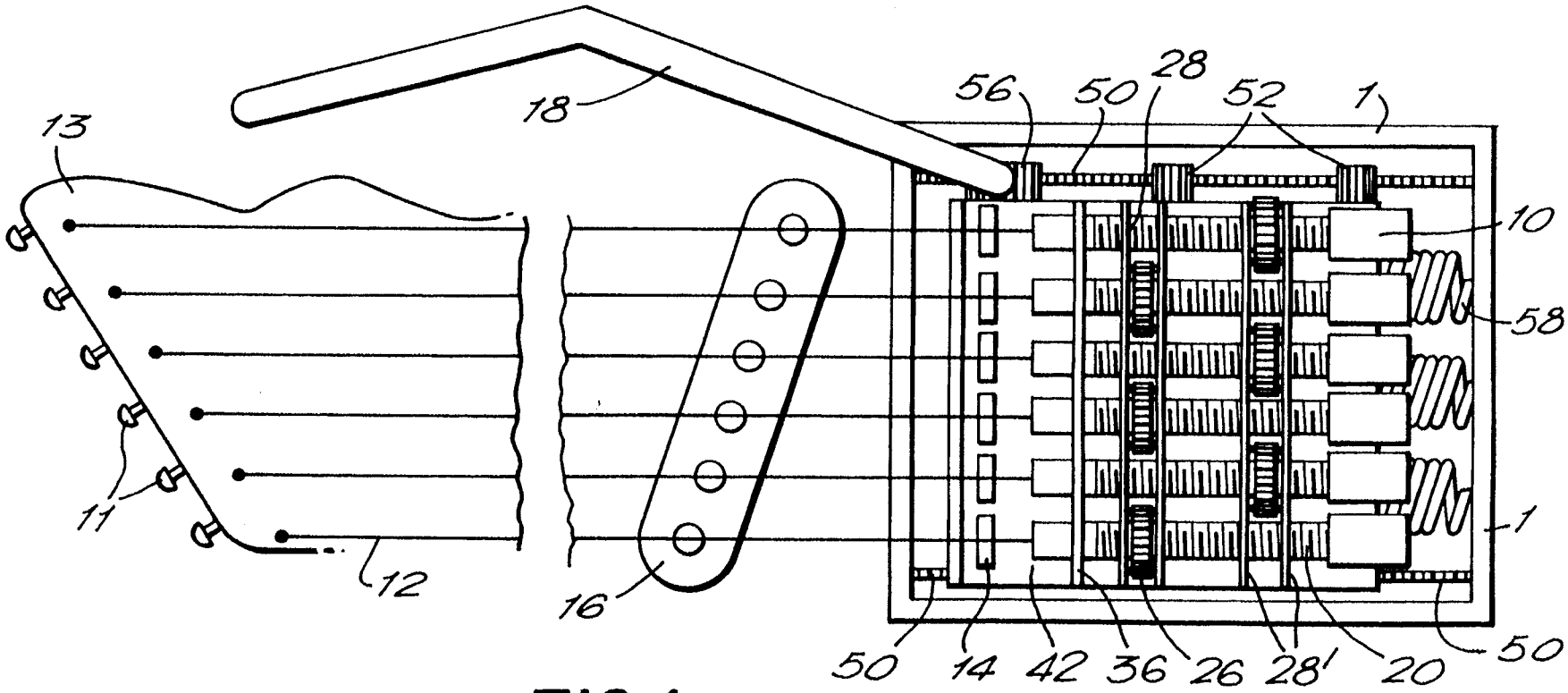
FIG. 1 shows a plan view of part of the body of a guitar incorporating a first embodiment of apparatus of the invention.

FIG. 1 shows a plan view of apparatus 1 for automatically varying the pitch of the strings of a guitar. The apparatus 1 is received in a recess in the body 15 of a guitar to replace the conventional string anchoring bar and the guitar bridge. Six strings 12 are attached at one of their ends to the apparatus 1 and extend along the neck (not shown) of the guitar. The other end of each of the strings 12 is anchored to the guitar neck 13 for example, by conventional tensioning pegs 11. Each string 12 is stretched or tensioned such that it produces a tone when vibrated.

A conventional pick-up 16 is fitted to the guitar body 15 proximate the strings 12. A tremolo arm 18 is provided on the guitar body 15, and is connected to the apparatus 1.

FIG. 1 only shows a part of the guitar body 15 for clarity, and because the parts thereof which are not illustrated are preferably conventional.

It will be understood that the strings of a guitar are adjusted, for example, by adjusting their tension and/or length to adjust the pitch of the tone they produce when vibrated. Commonly, one of the stretched strings is tuned by ear to a reference pitch or frequency and the remaining strings are then tuned by ear to have pitches at predetermined, differing intervals from the reference.

As a tuned guitar is being played, one or more of the strings may become out of tune. However, if the player of the guitar is giving a performance it is difficult to re-tune the instrument because of the need for the player to listen to the pitches being produced, and also because of the time needed, especially where a number of the strings need to be re-tuned. The apparatus 1 illustrated enables automatic, silent and quick re-tuning in these circumstances.

The apparatus 1 illustrated comprises six adjusting mechanisms 10 which are arranged side-by-side. The one end of each string 12 is attached to a respective one of the adjusting mechanisms 10. Each said adjusting mechanism 10 is electronically actuable to adjust the tension of its respective string 12 to thereby alter the pitch of that string. The six adjusting mechanisms 10 are located on one side of a guitar bridge 14 remote from the neck of the guitar.

Figure 2:
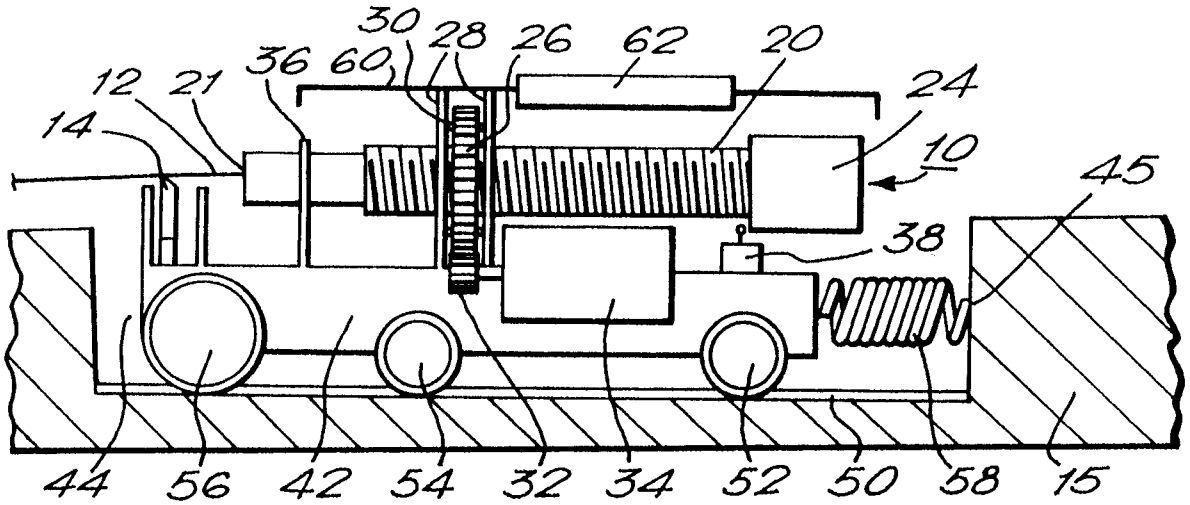
FIG. 2 shows a side elevational view of the apparatus of FIG. 1.

The adjusting mechanisms 10 are each substantially identical. A side elevational view of one of the adjusting mechanisms 10 is shown in FIG. 2. The adjusting mechanism 10 illustrated is supported on a carriage 42 of the apparatus 1 and comprises an elongate tubular member 20 within which the respective string 12 extends. The tubular member 20 acts to guide the string 12 to the top of the bridge 14. An anchoring point (not shown) for said one end of the string is provided within an enlarged end portion 24 of the tubular member 20.

With the exception of its two end portions, the outer surface of the tubular member 20 is screw-threaded. This screw-thread co-operates with the screw-threaded inner surface of a central aperture (not shown) of a gear-wheel 26. A pair of elongate, substantially parallel plates 28 extend upwardly from the carriage 42 and provide support for the gear-wheels 26 of one or more of the adjusting mechanisms 10. As can be seen in FIG. 1, in the illustrated embodiment the plates 28 provide support for the three gear-wheels 26 of three adjusting mechanisms, whilst the gear-wheels 26 of the three alternate adjusting mechanisms are supported by a second pair of substantially parallel, upstanding plates 28'. Furthermore, the plates 28, 28' are apertured (not shown) for the passage there through of the tubular members 20 such that the plates 28, 28' provide support for the tubular members 20. The plates 28, 28' of each pair are located on opposite sides of each gear-wheel 26 which is to be supported thereby. Each gear-wheel 26 is connected to the two plates of the respective pair by way of low-friction coupling means 30 enabling rotation of the supported gear-wheel 26. For example, and as illustrated, said coupling means 30 may comprise a plurality of ball bearings held captive in the sides of the gear-wheel 26 and engaged in a respective annular groove (not shown) formed in the facing surface of each of said plates 28, 28'. Each such annular groove will surround an aperture in the plates 28, 28' through which the respective tubular member 20 extends.

Each adjusting mechanism 10 comprises an electric drive motor 34 for rotating its tubular member 20. For example, the drive motor 34 may have a drive shaft (not shown) connected to a drive gear 32 engaged with the gear-wheel 26. In the embodiment illustrated, the diameter of the drive gear 32 is smaller than that of the gear-wheel 26. It will be appreciated that actuation of the drive motor 34 causes rotation of the gear-wheel 26 and hence, by way of the coupling means 30, causes the tubular member 20 to be moved longitudinally. The direction of rotation of the gear-wheel 26 determines whether the tubular member moves forward or back, that is, to the left or to the right as seen in FIG. 2.

Further support for each tubular member 20 is provided by a third plate 36 upstanding from said carriage 42. This plate 36 slidably receives an unthreaded front portion 21 of each tubular member 20 through a respective aperture (not shown) therein. In order to prevent rotation of each tubular member 20, the outer surface of its front portion 21 and the corresponding aperture in the plate 36 are square in cross-section. Alternatively, flats may be provided on the front portion 21 of each said tubular member.

A respective micro-switch 38, supported on the carriage 42, is provided proximate the rear end of each tubular member 20 and is arranged to be switched by contact with the enlarged end portion 24 of that tubular member 20. Each switch 38 is positioned such that when the respective tubular member 20 is at a null position, it contacts the micro-switch 38 and switches it into an off position. In addition, each adjusting mechanism is arranged such that the gear-wheel 26 thereof is at an intermediate position along the screw-threaded portion of the tubular member 20. This ensures that the tubular member 20 can be moved both forwardly and rearwardly relative to the null position. As it does so, the tubular member 20 causes the micro-switch 38 to be moved correspondingly forwardly or rearwardly take up a positive or negative on position. The tubular member 20 would be positioned in its null position when a new string 12 is being attached thereto, for example, when the guitar is being restrung.

The bridge 14 of the apparatus 1 is carried by the carriage 42 and extends upwardly to space the strings 12 above the body 15 of the guitar. The bridge 14 is provided with six piezoelectric pick-ups or sensors 40 along the top thereof, each of which is arranged to be contacted by a respective string 12.

The carriage 42 which supports the six adjusting mechanisms 10 and the bridge 14 is retained within a recess 44 within the guitar body 15. The carriage 42 is movable within the recess 44 along a pair of racks 50 (seen in better detail in FIG. 1) which extend longitudinally along the base of the recess 44. Longitudinally spaced pinions 52, 54 and 56 are fitted to each side of the carriage. 42 and are arranged to run along a respective rack 50. Three coil springs 58 attach the rear end of the carriage 42 to the rear end of the recess 44 and act to urge the carriage 42 rearwardly.

The tension of the stretched strings 12 acts in opposition to the force of the coil springs 58 and this causes the carriage 42 to adopt a predetermined position along the racks 50, and hence relative to the guitar body 15, and to maintain this position, for example, whilst the guitar is played. The bridge 14 is positioned on the carriage 42 so that, when the carriage 42 is in its predetermined position, the bridge 14 has the required mathematical correspondence with the position of the frets on the finger board of the guitar neck.

The tremolo arm 18 is connected to one of the front pinions 56 of the carriage 42 such that pivoting of the arm 18 rotates that pinion and thereby moves the carriage 42 along the racks 50. It will be apparent that in so doing, the tension of all six strings 12 will be varied together whereby a tremolo sound of varying pitch is produced which is similar to that provided by known tremolo arms. A locking device (not shown) may be provided to lock the carriage 42 in position, and thereby to lock the tremolo arm.

A removable cover plate 60 is provided for enclosing the apparatus 1 in the recess 44. In the embodiment illustrated, a unit 62, which is formed of a key pad and a display, is supported by the cover plate 60.

The operation of the apparatus 1 is controlled by means of electronic circuitry. In this respect, signals produced by the piezoelectric sensors 40 of the bridge 14 are used in controlling the operation of the motors 34 and thereby to vary the tension of the strings 12.

Figure 3:
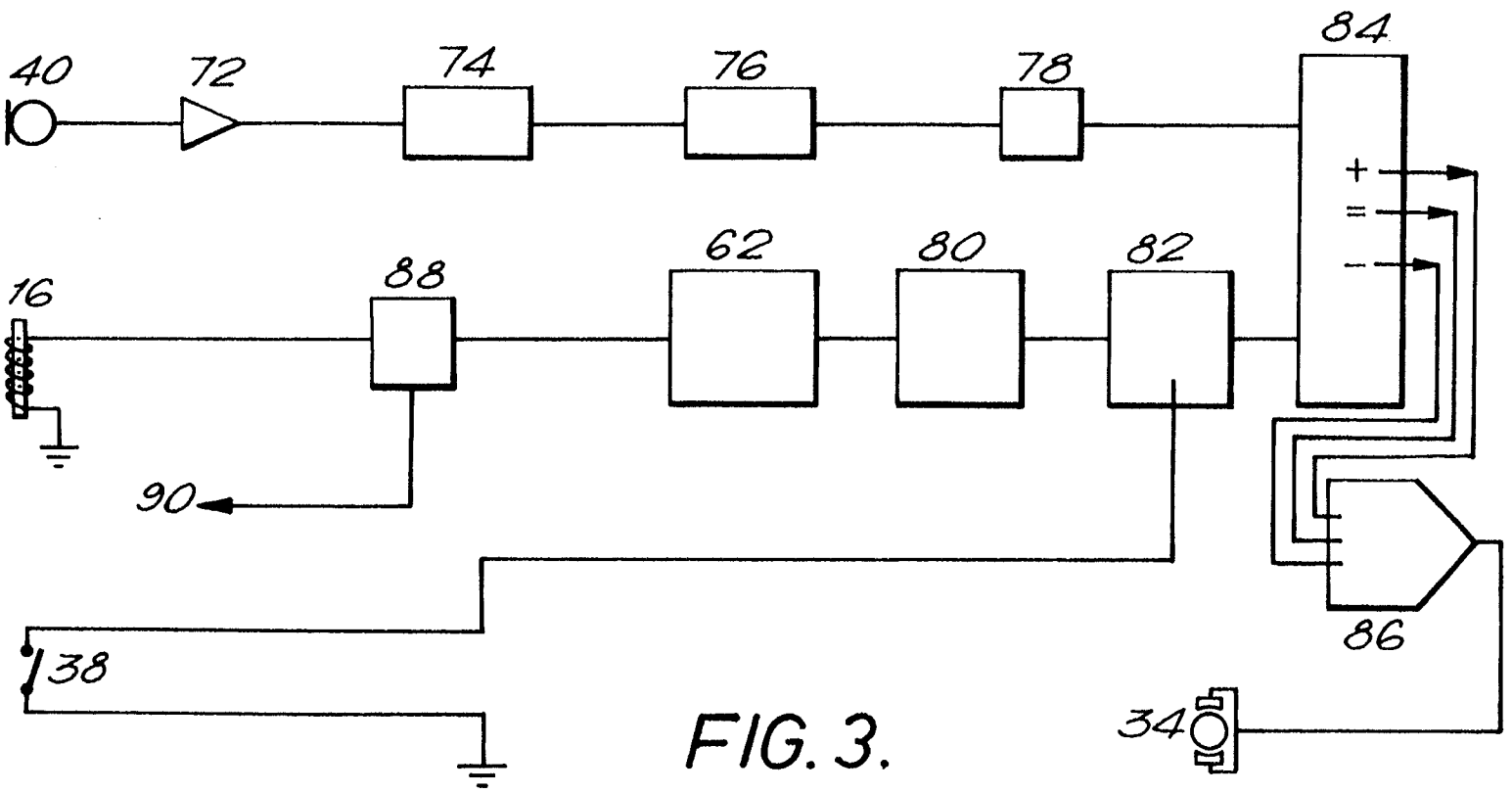
FIG. 3 shows a block diagram of electronic circuitry associated with the apparatus of FIGS. 1 and 2.

A block diagram of an electronic circuit which is associated with one of the strings 12 and its corresponding adjusting mechanism 10 is shown in FIG. 3. As can be seen, the piezoelectric sensor 40, which is contacted by the string 12, is connected to a band-pass filter 74 via an amplifier 72. The piezoelectric sensor 40 is arranged to produce an output signal which depends upon the frequency of the vibration of the string 12, and hence upon the pitch of that string. The band-pass filter 74 removes unwanted components, such as harmonics, from the output signal. The signal output from the band-pass filter 74 will be substantially periodic and representative of the pitch of the string.

The output of the band-pass filter 74 is connected to a pulse shaper 76 arranged to modify the signal to produce an output in a form suitable for driving a digital counter 78. The counter 78 is arranged to be actuated by the signal produced by the pulse shaper 76 so as to produce an output count which is representative of the pitch of the string. For example, the signal output from the pulse shaper 76 may be fed to the counting input of the counter 78 and arranged to enable the counter for a predetermined time period. Alternatively, the output from the pulse shaper 76 may be used to enable the counter 78 whilst a signal having a predetermined reference frequency is fed to the counting input. The output count of the counter 78 thereby produced is applied to one input of a digital comparator 84.

The key pad and display unit 62 is connected by way of a suitable interface to a memory 80 which is connected to a selector buffer 82. The memory 80 is arranged to store reference values which are representative of various pitches, and preferably also stores standard values which are representative of preselected reference pitches. Preferably, at least said standard values are stored in non-volatile memory and preferably in read only memory. In an embodiment, the memory 80 is generally random access memory (RAM), but a portion thereof is read only memory, such as ROM or EPROM.

The selector buffer 82 is arranged, by instructions fed by way of the unit 62, to select from memory 80 an appropriate reference value, which is representative of the pitch to which the associated string is to be tuned. This reference value is fed to a second input of the digital comparator 84. The digital comparator 84 can then compare two inputs, that is, the output count from counter 78 which is representative of the actual pitch, and the reference value, and produce an output voltage in dependence upon the comparison. The output of the comparator 84 is fed by way of an amplifier 86 to the drive motor 34.

The null-point micro-switch 38 is connected, by way of control circuitry (not shown), to the selector buffer 82. In addition, the pick-up 16 is connected to a substantially conventional output 90 by way of a mute circuit 88. The mute circuit 88 is also connected to the key pad and display unit 62.

During tuning, the string 12 is made to vibrate so that the piezoelectric sensor produces a voltage signal across its output. The electrical output signal from the piezoelectric sensor 40, which will contain components of various frequencies, one of which is representative of the pitch, is amplified by the amplifier 72. The filtered signal output from the band-pass filter 74 is fed to the pulse shaper 76 which generates an output in the form of periodic pulses suitable for actuating the digital counter 78. It will be apparent that the frequency of the pulses will correspond to, or be representative of, the sound pitch.

The counter 78 is actuated to count in accordance with the frequency of the incoming pulses, and so produces an output count representative of the sound pitch. This count is then compared to the reference value, selected from the values stored in memory 80, by the digital comparator 84. The comparator 84 produces an output which is dependent upon the result of the comparison. If the count from the counter 78 is greater than the reference value, the output of the digital comparator 84 will be positive, whilst if the count is lower than the reference value, the output of the comparator 84 will be negative. If the two outputs substantially coincide, the digital comparator 84 produces no output, which is indicative of the string 12 being tuned to the pitch represented by the selected reference value.

If the output of the digital comparator 84 is positive, the drive motor 34 is actuated to cause rotation of gear-wheel 26 in a direction to move the tubular member 20 forwardly, that is, to the left as shown in FIG. 2. This reduces the tension of the string 12 attached to the member 20, and also reduces the pitch of the stretched string. If the output of the comparator 84 is negative, the drive motor 34 is actuated to rotate the gear-wheel 26 in the opposite direction so as to move the tubular member 20 rearwardly. This increases the tension of the stretched string 12 and increases its pitch. It will be appreciated that appropriate actuation of the drive motor 34 is continued until the actual pitch of the string 12, represented by the output count of the counter 78, is at the selected frequency, represented by the selected reference value output by the buffer 82.

In the embodiment illustrated each of the six adjusting mechanisms 10 has a separate, associated electronic circuit so that each said mechanism is independently actuatable. However, a single, common keypad and display unit 62 and a common memory 80 are preferably provided and connected to all of the electronic circuits for all of adjusting mechanisms 10.

As shown, the key pad and display unit 62 are supported by the cover plate 60 of the recess 44 of the guitar body 15. Conveniently, the electronic circuits for the adjusting mechanisms 10 may also be supported by the cover plate 60 or otherwise by the guitar body 15 in, or adjacent to, the recess 44. For example, a printed circuit board (not shown) carrying the electronic circuits may be supported by the cover plate 60 or within the carriage 42.

The key pad of the unit 62 is provided with a number of control keys (not shown). For example, these control keys may comprise a master key; six individual string keys; input keys, associated with a mode key, to set reference values into memory; a tuning key; a reference pitch key, for use in tuning a string to a standard reference pitch; a null key, for setting an adjusting mechanism 10 to its null position; and a mute key. Control logic or software enables program routines to be enabled by actuation of the keys. In this respect, appropriate processor means (not shown) are provided, for example, in said unit 62 and/or associated with the memory 80.

The display of the unit 62 comprises a liquid crystal display associated with the key pad, and a second display. The second display is provided with six sets of light emitting diodes (LEDs) for indicating the state of tubing of each of the strings. Each set of LEDs is associated with one string and comprises a first LED arranged to be illuminated when the pitch is below a selected frequency, a second LED arranged to be illuminated when the pitch is above a selected frequency, and a third LED which is arranged to be illuminated when the string has a pitch tuned to a selected frequency. For the convenience of the guitar player, each set of LEDs is preferably positioned proximate its corresponding string 12.

The master key (not shown) on the key pad enables actuation of all six of the adjusting mechanisms 10 simultaneously. Thus, for example, all six strings may be tuned to an individually selected pitch by actuating the tuning key together with the master key. This starts a tuning routine for all of the strings in which each of the six digital counters 78 is caused to count incoming pulses and to apply the output count to the comparator 84, and the associated selector buffer 82 applies a selected reference value to the comparator 84 to produce an appropriate comparator output. As described previously, the output of the comparator is used to actuate the drive motor of the corresponding adjusting mechanism.

If it is required to tune only one of the strings 12, the string key for that string is activated together with the tuning key. This causes a tuning routine for the single selected string to be run. Similarly, tuning routines for selected ones of the strings are selected by activating the tuning key together with the corresponding string keys. Thus, any one or any combination of the six strings 12 can be tuned individually or together to pitches selected for the strings concerned.

The input keys are used to enable reference values representative of required pitches for each of the strings to be input into memory 80. To write reference values into memory 80, the mode key is activated to select "programming mode". The input keys, typically representing the numbers 0 to 9, are then activated to cause a number representative of the required pitch to be displayed on the LCD display. When set, the reference number of the selected pitch is written into memory 80 by activating either the master key, or one or more of the individual string keys. Activation of the master key stores the selected reference value in memory locations of the memory 80 associated with all six of the strings so that all of the strings can be tuned to the selected pitch. On the other hand, activation of an individual string key will store the selected reference value in a memory location of the memory 80 associated with the associated single string, so that that string can be tuned to the selected pitch.

Generally, the guitar player will find it easier to set values for the required string pitches which are presented in musical notation. Thus, the input keys may be arranged to represent, or to successively display, the tones A–G and each octave. A program routine, for example, utilising a look-up table in memory, is then arranged to produce a reference value for storage in memory which corresponds to a selected tone.

During a tuning routine, the reference values are accessed from the memory 80 by activating the tuning key and, as required, the master key or one or more individual string keys. As described above, when the master key is activated, each string is tuned to the pitch represented by the reference value stored for that string. However, when individual strings are tuned, this can be to the pre-selected associated pitch, or to any of the other pitches represented by the stored reference values. The strings can thus be tuned to non-standard pitches.

The reference pitch key is used in combination with the tuning key and either the master key or one or more of the individual string keys, to tune one or more of the strings to a pre-programmed standard reference pitch. When these keys are activated, the selector buffer 82 is arranged to access the read only memory in which standard values corresponding to pre-selected reference pitches are stored. The accessed standard values are then used in the actuated tuning routine in the manner described above.

Normally it is arranged that the output 90 is disabled during tuning operations. However, activation of the mute key is arranged to maintain the output enabled during tuning operations. The player is thus able to hear the changes in pitch of the or each string as tensions are changed.

When a new string 12 is to be fitted to the guitar, the corresponding adjustment mechanism 10 is set null position by activating the null key and the associated individual string key. It will be recalled that movement of the adjustment mechanism 10 causes the micro-switch 38 to assume a positive or a negative on position. Activation of the null key causes the selector buffer 82 to look at the condition of the micro-switch 38 and to cause an appropriate output value to be fed to the comparator 84 generate a positive or negative output to actuate the drive motor 34. When the null position of the tubular member 20, and hence of the adjustment mechanism 10, is reached, the micro-switch 38 is switched to its off position and no further movement of the adjusting mechanism is caused. The string can then be fed through the tubular member 20. The end of the string is knotted or has a suitable stop fixed to it, and this stop or knotted end is anchored to the anchoring point within the enlarged end portion 24. The other end of the string 12 is fed onto its respective tensioning peg at the stringing head (not shown) of the guitar neck.

The newly strung string is brought coarsely into tune manually by activation of the tensioning peg, and then adjusting mechanism 10 is actuated, by activation of the tuning key and the corresponding individual string key or the master key, to tune the string to the pitch represented by the stored reference value.

Positioning the adjusting mechanism 10 at its null point prior to tuning the newly strung string ensures the adjusting mechanism 10 can be moved in either direction during tuning so as to increase or decrease the tension of the string.

It will be appreciated that the apparatus enables newly strung guitar strings to be quickly and easily tuned to the selected pitch.

One or more strings can be re-tuned by activating the tuning key and the master key or the appropriate individual string keys. If one or more of the strings have been tuned to non-standard pitches, activation of appropriate keys will enable the apparatus to re-tune these strings to the standard reference pitches. As will be appreciated, tuning and re-tuning operations undertaken by the apparatus are performed very rapidly, for example, in a few seconds.

The software determining the program routines described above is not further described herein as production will be within the competence of anyone skilled in the art.

In the embodiment illustrated in FIGS. 1 to 3, the pitch of a string 12 is adjusted by moving the associated tubular member 20 forwardly or rearwardly by way of a respective gear wheel 26. It will be appreciated that the drive motor 34 has to develop sufficient power to cause this movement, and there can be difficulties in providing a drive motor 34 which is small enough and yet sufficiently powerful.

Figure 5:
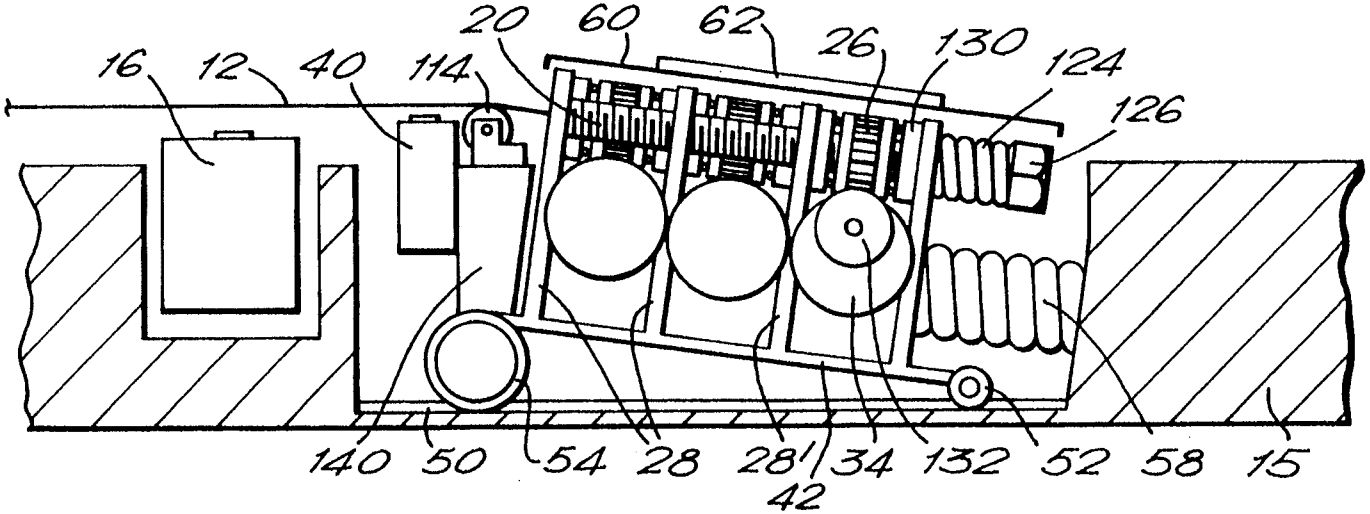
FIG. 5 shows a side elevational view of the apparatus of FIG. 4.
Figure 4:
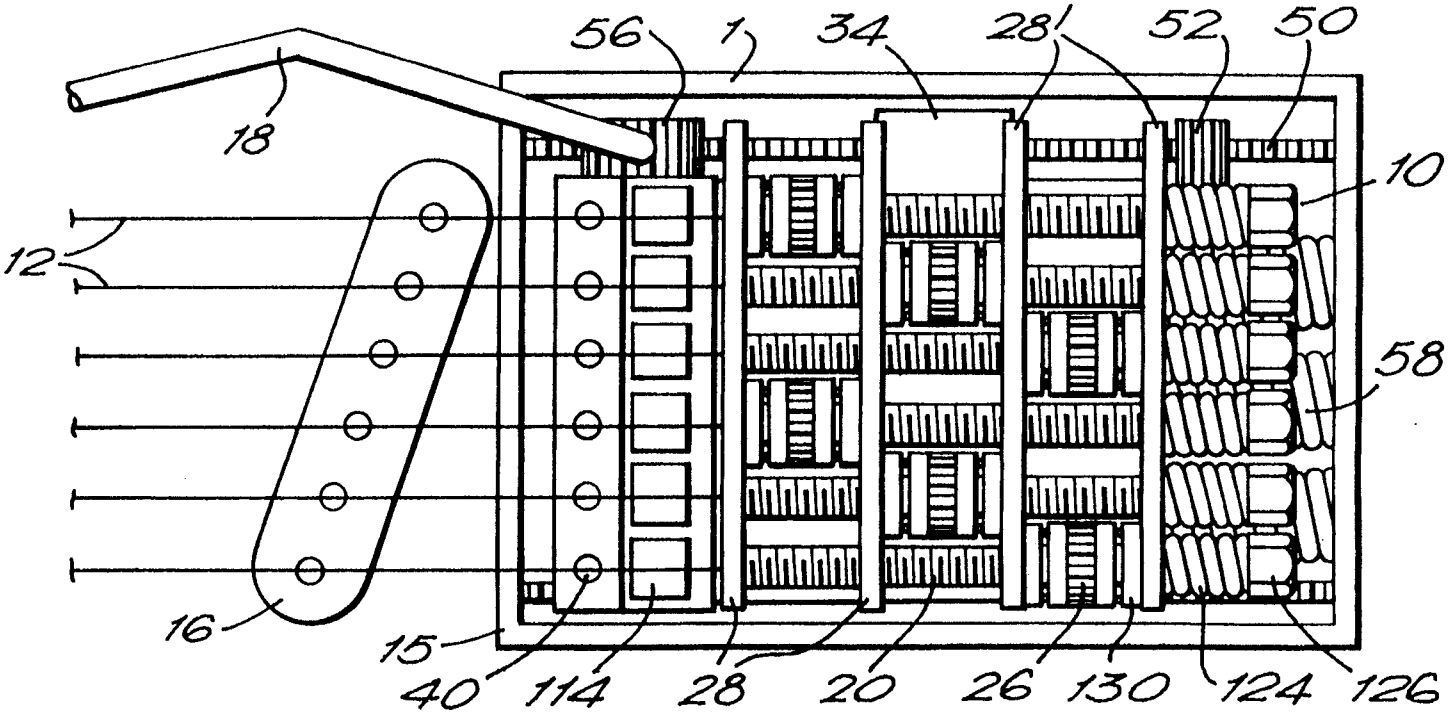
FIG. 4 shows a plan view of part of the body of guitar incorporating a second embodiment of apparatus of the invention.

FIGS. 4 and 5 show an alternative embodiment in which a less powerful drive motor can be used. In this respect, in the embodiment of FIGS. 4 and 5, each string 12 is held at a tensioned, null position, by a spring force. This means that the drive motor 34 needs only to be able to power adjustment of the tension of the corresponding string 12, rather than having to supply all of the tension of the string 12 as in the previous embodiment.

In FIGS. 4 and 5, parts and features which are the same or similar to parts and features of the embodiment of FIGS. 1 and 2 have been given the same reference numerals.

As previously, the apparatus 1 shown in FIGS. 4 and 5 comprises six adjusting mechanisms 10 which are arranged side by side, and the one end of each string 12 is attached to a respective one of the adjusting mechanisms 10. The six adjusting mechanisms 10 are located on one side of a guitar bridge 114 remote from the neck of the guitar. In this embodiment, the brige is formed by individual bridge pieces 114 each in the form of a roller.

As before, the six adjusting mechanisms 10 are each substantially identical, and a side elevational view of one of them is shown in FIG. 5. The adjusting mechanism 10 illustrated is supported on the carriage 42 and comprises an elongate tubular member 20 within which the respective string 12 extends. The tubular member 20 acts to guide the string 12 to the top of the bridge 114. An anchoring point (not shown) for said one end of the string is provided within the tubular member 20.

The outer surface of the tubular member 20 is screw-threaded. This screw-thread co-operates with the threaded interior of a spur gear 26 supported between a pair of substantially parallel mounting plates 28. In the embodiment of FIG. 4, four spaced plates 28 provide support for the six spur gears 26. As before, the plates 28 are apertured (not shown) so that the tubular members 20 can extend therethrough and be provided with support. Each spur gear 26 is connected to the two plates 28 of the respective pair by way of low-friction coupling means 130 enabling rotation of the supported gear 26. For example, and as illustrated, said coupling means 130 may comprise a respective thrust bearing 130 interposed between one side of the gear 26 and a facing surface of the adjacent plate 28.

The drive motor 34 of each adjusting mechanism 10 is, in this embodiment, provided with a worm drive 132 engaging with the gear 26 for rotating its tubular member 20. Although each d.c. drive motor 34 is arranged to cause rotation of the gear 26, and hence to move the Tubular member 20 longitudinally, in the embodiment of FIGS. 4 and 5 biassing means are arranged to support the tension in the strings 12 and to effectively provide a coarse adjustment for this tension. In the illustrated embodiment, the biassing means associated with each string 12 comprises a coil spring 124 having one end fixed to the rear end of the tubular member 20 and its other end fixed to a spring adjuster and lock nut 126. As the adjuster 126 is adjusted to compress the spring 124, increasing tension is applied to the string 12 against the spring force of the coil spring 124. Thus, in the null position, the tension in the string 12 is balanced by the force of the coil spring 124. This means that a relatively small force from the drive motor 34 will be able to provide a fine adjustment of the string tension. It is also means that the null position is set by the adjusted condition of the coil spring 124 and that a micro-switch or other means to establish the null position is not required.

In the embodiment of FIGS. 4 and 5, the sensors 40 for the individual strings 12 are carried by a bridge support 140 which also supports the bridge pieces 114.

As previously, the carriage 42 is movable along a pair of longitudinal racks 50, but in this embodiment, this is by way of a pair of longitudinally spaced pinions 52 and 56. The carriage 42 is urged rearwardly by way of the three coil springs 58 attached to the rear end of the carriage 42. It is the tension of the stretched strings 12 acting in opposition to the force of the coil springs 58 which causes the carriage 42 to adopt a predetermined position relative to the guitar body 15. The tremolo arm 18 is connected to one of the front pinions 56 of the carriage 42 such that pivoting of the arm 18 rotates that pinion and thereby moves the carriage 42 along the racks 50.

The operation of the apparatus 1 of the embodiment of FIGS. 4 and 5 is substantially as described above with reference to FIGS. 1 and 2. However, in the electronic circuit as shown in FIG. 3 the micro-switch 38 can be omitted.

In the embodiments described above, the electronic circuits for controlling the adjusting mechanisms, the display and monitoring means associated therewith, and the user input interface, in the form of the key pad, are all positioned on the guitar body. However, it will be appreciated that any one of these integers may be arranged at a remote location and suitably coupled or connected to the guitar. In particular, players may find it convenient to be provided with an input interface arranged in the form of one or more foot pads or pedals.

The tremolo arm 18 is connected to the apparatus 1 such that pivoting of the arm causes a sound of varying pitch. If required, this effect can also be caused by actuation of the adjusting mechanisms by way of the electronic circuits. For example a tremolo program routine can be arranged to apply differing reference values to each of the comparators 84 whereby a continuous tuning operation is carried out whilst the guitar is played. As previously, movement of the adjusting mechanisms will cause the tensions of the strings 12 to vary in accordance with the change in reference values.

In the embodiments described, the pitch of each string is varied by adjusting its tension. However, it will be appreciated that additionally and/or alternatively the adjusting mechanisms may vary the effective length of the strings. Furthermore, whilst the invention has been described specifically with reference to guitars, apparatus of the invention may be used to vary the tuning of any instrument comprising stretched strings.

Other modifications and alterations to the above described embodiment may be made within the scope of the invention.

I claim:

1. Apparatus arranged to automatically vary the pitch of a string, said apparatus comprising:

a string having first and second spaced ends;

an adjusting mechanism coupled to said first end of said string; and anchoring means for anchoring said second end of said string:

said string being stretched and tensioned between said adjusting mechanism and said anchoring means;

said adjusting mechanism comprising a movable adjustment member to which said first end of the string is anchored;

a drive motor;

means for coupling said drive motor to said adjustment member such that rotation of said drive motor moves said adjustment member and thereby adjusts the tension of the string;

detecting means arranged to produce a signal representative of the pitch produced by vibration of the string;

comparing means arranged to compare said representative signal with a predetermined reference and to produce an output dependent upon said comparison; and means for applying the output of said comparing means to said drive motor to rotate the drive motor thereby adjusting the tension applied to said string in response to said output of said comparing means;

wherein said adjusting mechanism further comprises resilient biasing means coupled to said movable adjustment member to bias said adjustment member in a direction opposing the tension of the;

wherein said detecting means comprises pulse generating means for generating periodic pulses having a frequency representative of the pitch of the vibration of the string, and a counter receiving said periodic pulses and producing an output count representative of said pitch; and wherein said adjustment member comprises a screw-threaded member attached to said end of said string, and said means for coupling said drive motor to said adjustment member comprises one or more gears.

2. Apparatus according to claim 1, wherein said gear is arranged to be rotated by said drive motor and cooperates with the screw-thread of said adjustment member whereby rotation of said gear causes movement of said member longitudinally of the string attached thereto.

3. Apparatus according to claim 2, wherein said adjustment member comprises a tubular member within which the string extends, said screw-thread being provided externally of said tubular member and arranged for engagement with said gear.

4. Apparatus according to claim 1, wherein said comparing means is a digital comparator, and further comprising a memory arranged to store a plurality of reference values, and selector means for selecting one of the stored values for use as the reference by said comparator.

5. Apparatus according to claim 4, wherein interface means are provided and are arranged to enable the input and/or variation of the values stored in said memory.

6. Apparatus according to claim 4, further comprising indicator means responsive to the output of said comparator.

7. Apparatus according to claim 6, wherein said indicator means comprise visual display means.

8. Apparatus according to claim 1, wherein said detecting means comprises a vibration sensor arranged proximate to, or in contact with, said string.

9. Apparatus arranged to automatically vary the pitch of a plurality of strings, said apparatus comprising:

a plurality of strings, each said string having first and second spaced ends;

a plurality of adjusting mechanisms, each said adjusting mechanism being coupled to the first end of a respective one of said strings;

anchoring means anchoring the second ends of the strings;

each said string being stretched and tensioned between a respective one of said adjusting mechanisms and said anchoring means;

each said adjusting mechanism comprising a moveable adjustment member to which said first end of said respective one of said strings is anchored;

a drive motor; and means for coupling said drive motor to one of said adjustment members such that rotation of said drive motor moves said one of said adjustment members and thereby adjusts the tension of the respective one of the strings;

wherein each said adjusting mechanism further comprises resilient biasing means coupled to each said movable adjustment member to bias each said adjustment member in a direction opposing the tension of the respective one of the strings, and each said adjustment member comprises a screw-threaded tubular member within which each said string extends, one of said screw-threaded tubular members being coupled to said drive motor by said coupling means.

10. Apparatus according to claim 9, wherein said coupling means comprises a gears arranged to be rotated by said drive motor and cooperating with the screw-thread of said one of said tubular members whereby rotation of said gear by said drive motor causes movement of said one of said tubular members longitudinally of the respective one of said strings attached thereto.

11. Apparatus according to claim 9, further comprising detecting means arranged to produce a signal representative of the pitch produced by vibration of one of said plurality of strings, and comparing means arranged to compare said representative signal with a selected reference.

12. Apparatus arranged to automatically vary the pitch of a plurality of strings, said apparatus comprising:

a plurality of strings, each said string having first and second spaced ends;

a plurality of adjusting mechanisms, each said adjusting mechanism being coupled to the first end of a respective one of said strings;

anchoring means anchoring the second ends of the strings;

each said string being stretched and tensioned between a respective one of said adjusting mechanisms and said anchoring means;

each said adjusting mechanism comprising a moveable adjustment member to which said first end of said respective one of said strings is anchored;

a drive motor; and means for coupling said drive motor to one of said adjustment members such that rotation of said drive motor moves said one of said adjustment members and thereby adjusts the tension of the respective one of the strings;

wherein each said adjusting mechanism further comprises first resilient biasing means coupled to each said movable adjustment member to bias each said adjustment member in a direction opposing the tension of the respective one of the strings; and wherein said apparatus further comprises a movable carriage on which each said adjusting mechanism is supported, second resilient biasing means for biasing said carriage to an initial position; and a tremolo arm coupled to said carriage to move said carriage against the action of said second biasing means.

13. Apparatus according to claim 12, wherein said carriage is movable longitudinally of said strings whereby movement of the carriage is arranged to vary the pitch of all of said strings.

14. Apparatus according to claim 12 wherein each said adjustment member comprises a screw-threaded tubular member within which the respective one of said strings extends, one of said screw-threaded tubular members being coupled to the drive motor by said coupling means.

15. Apparatus according to claim 12, further comprising detecting means arranged to produce a signal representative of the pitch produced by vibration of one of said plurality of strings, and comparing means arranged to compare said representative signal with a selected reference.

16. Apparatus according to claim 15, further comprising storage means for storing a plurality of reference values, and selector means for selecting one of the stored values for use as the reference by said comparing means.

17. Apparatus according to claim 16, wherein interface means are provided and are arranged to enable the input and/or variation of the values stored in the storage means.

18. Apparatus according to claim 16, further comprising visual display means arranged to be responsive to the output of said comparing means.

19. Apparatus according to claim 16, wherein said detecting means arranged to produce a signal representative of pitch is a vibration sensor arranged proximate to, or in contact with, each said string.

* * * * *